US007777603B2

(12) United States Patent
Bamber et al.

(10) Patent No.: US 7,777,603 B2
(45) Date of Patent: Aug. 17, 2010

(54) ARMATURE AND SOLENOID ASSEMBLY

(75) Inventors: Daniel W. Bamber, St. Clair Shores, MI (US); Anthony J. Mattord, Rochester Hills, MI (US)

(73) Assignee: Eaton Corporation, Cleveland, OH (US)

( * ) Notice: Subject to any disclaimer, the term of this patent is extended or adjusted under 35 U.S.C. 154(b) by 582 days.

(21) Appl. No.: 11/744,026

(22) Filed: May 3, 2007

(65) Prior Publication Data

US 2008/0272871 A1 Nov. 6, 2008

(51) Int. Cl.
*H01F 3/00* (2006.01)
*H01F 7/08* (2006.01)

(52) U.S. Cl. ..... 335/279; 335/261

(58) Field of Classification Search ..... 335/255, 335/261, 262, 279; 251/129.16
See application file for complete search history.

(56) References Cited

U.S. PATENT DOCUMENTS 2,682,625 A 6/1954 Soreng et al
4,632,155 A * 12/1986 Maina ..... 139/452
5,547,165 A * 8/1996 Brehm et al. ..... 251/129.16
2005/0045840 A1 3/2005 Dzialakiewicz et al.

FOREIGN PATENT DOCUMENTS

| | | | |
|---|---|---|---|
| DE | 4329760 | A1 | 3/1995 |
| DE | 102004037269 | B3 | 12/2005 |
| EP | 0650002 | A1 | 4/1995 |
| EP | 0976957 | A2 | 2/2000 |
| EP | 1729309 | A2 | 12/2006 |
| GB | 580451 | A | 9/1946 |

OTHER PUBLICATIONS

European Patent Office; International Search Report and Written Opinion mailed Feb. 17, 2009 for PCT/IB2008/001090.

* cited by examiner

*Primary Examiner*—Ramon M Barrera
(74) *Attorney, Agent, or Firm*—Dykema Gossett PLLC

(57) ABSTRACT

An armature for a solenoid assembly is disclosed. The armature includes a first portion, a second portion, and a fin. The first portion has a first axial length and a first diameter, and the first portion is configured for operative connection with a pole piece. The second portion has a second axial length and a second diameter that is larger than the first diameter. The fin extends radially from the second portion and has an axial length that is less than the axial length of the second portion. A solenoid assembly is also disclosed.

22 Claims, 3 Drawing Sheets

ARMATURE AND SOLENOID ASSEMBLY

TECHNICAL FIELD

The present invention relates to an armature for solenoid devices.

BACKGROUND

It is desirable to attain both high force and a flat force in connection with the displacement curve provided by a linear solenoid. It is also desirable to be able to provide a high force for a full stroke of a proportional solenoid.

SUMMARY

An armature for a solenoid assembly is disclosed. The armature includes a first portion, a second portion, and a fin. The first portion has a first axial length and a first diameter, and the first portion is configured for operative connection with a pole piece. The second portion has a second axial length and a second diameter that is larger than the first diameter. The fin extends radially from the second portion and has an axial length that is less than the axial length of the second portion.

In connection with embodiments of the invention, the design of an armature assembly may be such that, among other things, the armature interacts with the housing to produce a force when the armature is far from a pole piece, but decreases as the armature approaches the pole piece. The assembly may be configured to provide a "canceling" of forces at the associated pole piece, thereby effectively providing a substantially flat force stroke curve. A solenoid assembly is also disclosed.

BRIEF DESCRIPTION OF THE DRAWINGS

Embodiments of the invention will now be described, by way of example, with reference to the accompanying drawings, wherein.

DETAILED DESCRIPTION

Reference will now be made in detail to embodiments of the present invention, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
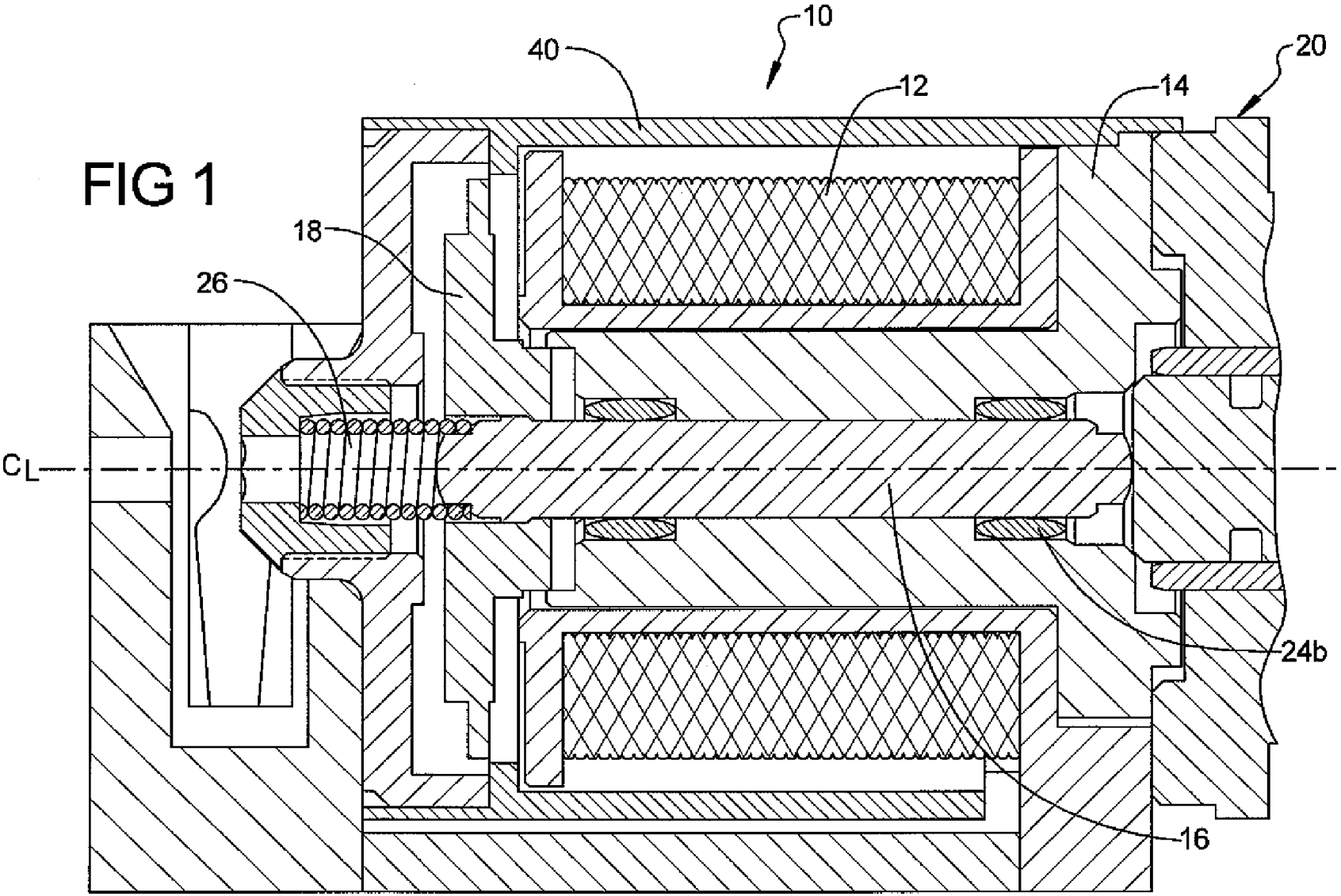
FIGS. 1 and 2 are cross-sectional views of assemblies for a magnetic solenoid according to embodiments of the invention.
Figure 2:
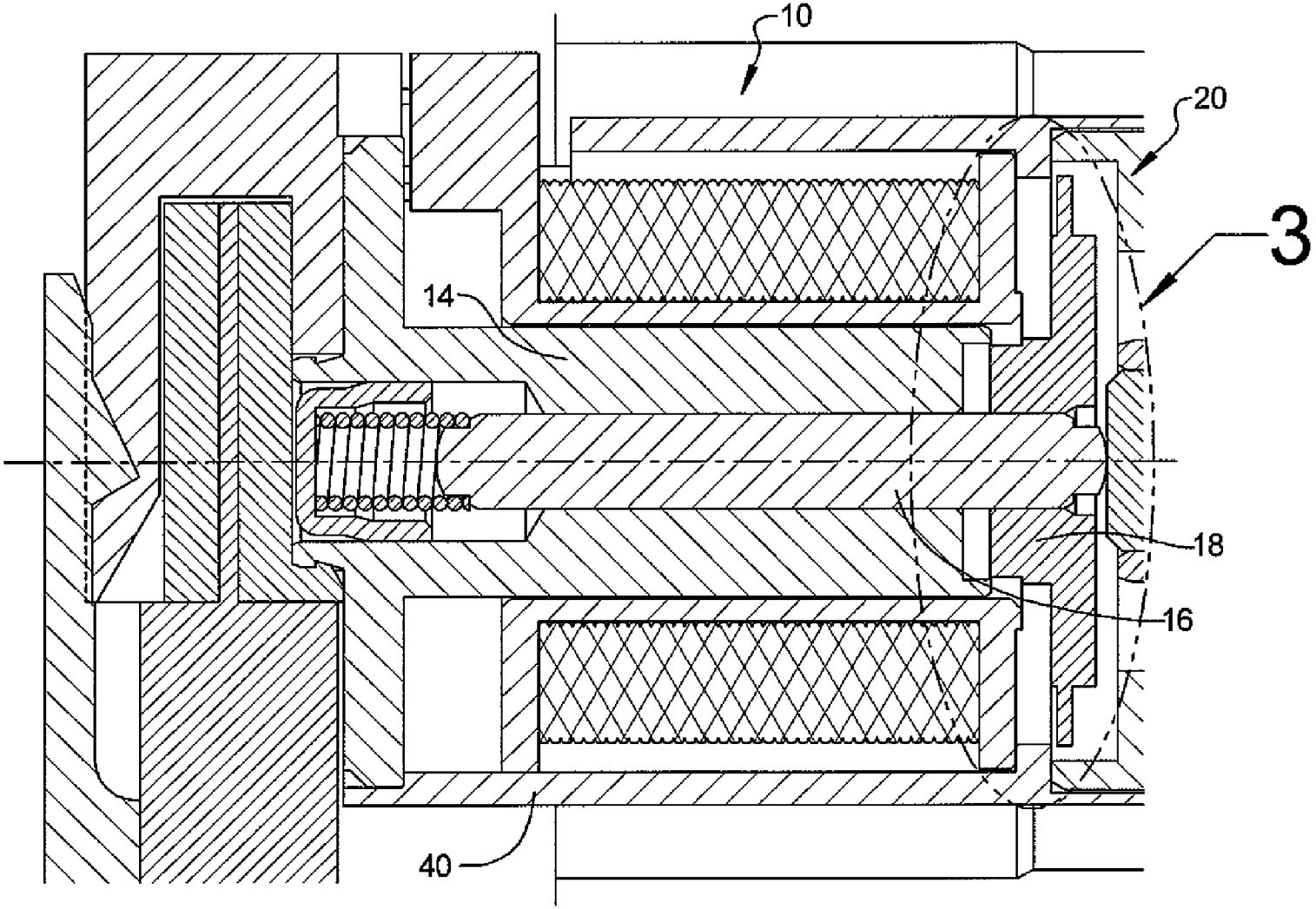

Different embodiments of solenoid assemblies 10 according to embodiments of the invention are generally shown in FIGS. 1 and 2. In the illustrated embodiments, the solenoid assemblies 10 are shown as part of larger valve assemblies. The illustrated solenoid assemblies each include a coil 12, a pole piece 14, an operating rod 16, and an armature 18. A centerline for each assembly is generally designated as CL. A portion of a valve body is generally designated as element 20. However, one of skill in the art will recognize that the invention is not limited to a valve body 20 of the types shown, and other forms and configurations of valve bodies may be employed without departing from the teachings of the invention.

Figure 3:
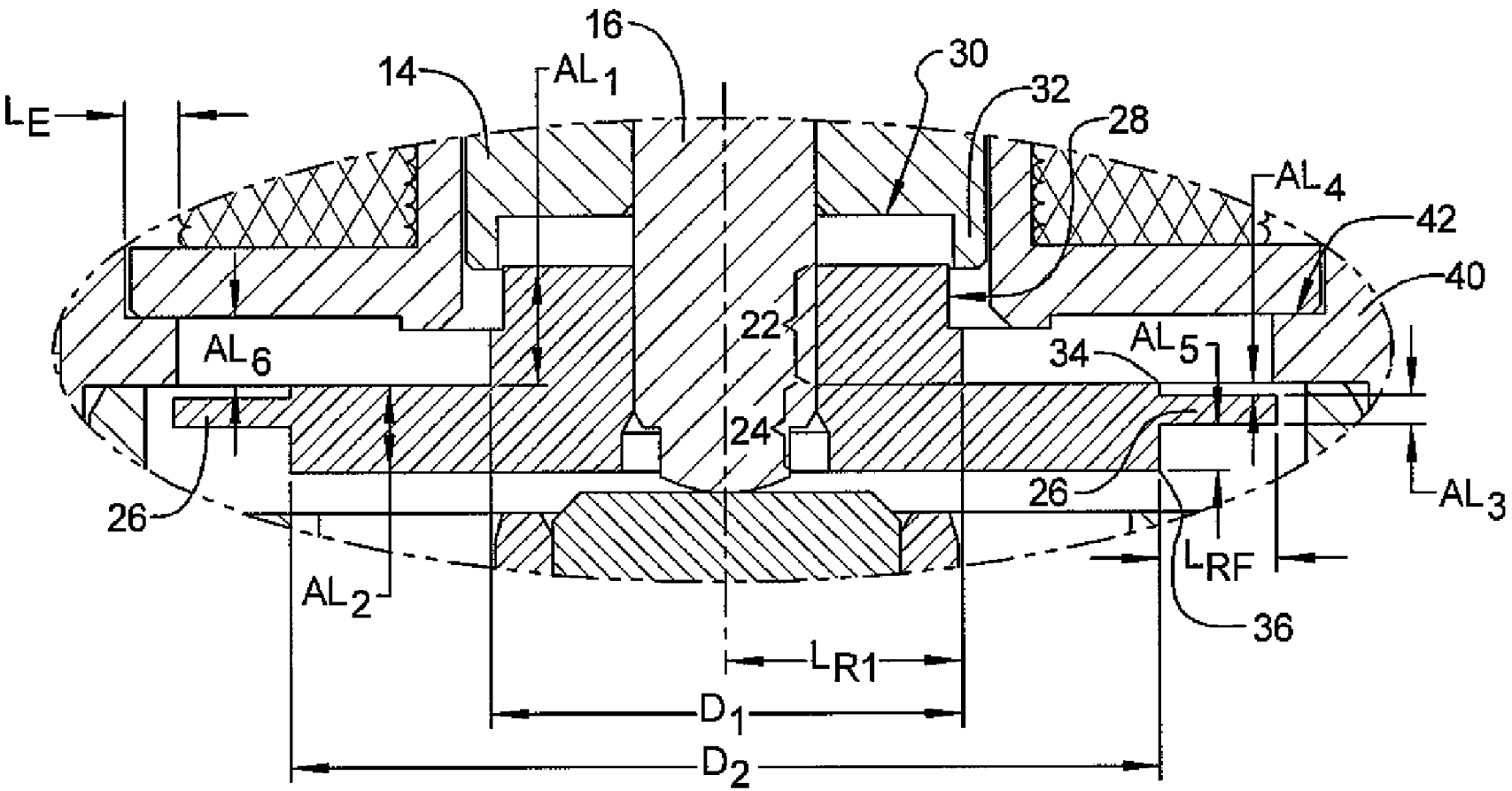
FIG. 3 is an enlarged cross-sectional view of III shown in FIG. 2.

FIG. 3 is an enlarged view of area III in FIG. 2 that generally illustrates a portion of an armature 18. In an embodiment, armature 18 is substantially symmetrical about the associated centerline CL. Armature 18 includes a first portion 22, a second portion 24, and a fin 26 that extends radially from the second portion. Armature 18 may be comprised of a magnetic material. Armature 18 may, for example and without limitation, be comprised of a magnetic steel.

First portion 22 includes a first axial length $AL_1$ and a first diameter $D_1$. As generally illustrated in FIGS. 1-3, first portion 22 may be configured for operative connection with a pole piece 14. Second portion 24 includes a second axial length $AL_2$ and a second diameter $D_2$, the second diameter $D_2$ being larger than the first diameter $D_1$. In an embodiment, fin 26 has an axial length $AL_3$ that is less than the axial length of the second portion $AL_2$. Moreover, the first portion 22, second portion 24 and fin 26 may be integrally formed.

In an embodiment, the first axial length $AL_1$ is longer than the second axial length $AL_2$. As generally illustrated in the figures, first portion 22 may include a reduced diameter portion 28 that is configured to interact with an end (generally identified as 30) of a pole piece 14. The end 30 of the pole piece 14 may include an extension 32 that interacts with armature 18. For embodiments of the invention, the second diameter $D_2$ of armature 18 may be configured to be at least twice the first diameter $D_1$.

The fins 26 illustrated in FIGS. 1-3 have, in cross-section, a substantially rectangular shape. However, those of skill in the art will recognize and understand that fin 26 is not limited to the forms illustrated, and rather may take the form of a number of shapes and configurations. It is noted that in an embodiment, the axial length $AL_3$ of fin may be less than one-half the axial length of the second portion $AL_2$. Also, for some embodiments, the radial length $L_{RF}$ of fin 26 may be less than the largest radial length $L_{R1}$ of first portion 22. As generally shown in FIG. 3, fin 26 may also be axially offset an axial distance $AL_4$ from a first endpoint 34 of second portion 24, and/or may be axially offset an axial distance $AL_5$ from a second endpoint 36 of second portion 24.

As generally illustrated in the Figures, assembly 10 includes a housing 40. Housing 40 may be comprised of some amount of plastic material to the extent that no magnetic effect is necessary. Housing 40 may further include an extension 42, such as a step, that extends radially inwardly from an inner wall of the housing and interacts with fin 26. The interaction between the extension 42 and the fin 26 typically takes the form of an electromagnetic communication. Extension 42 is generally positioned so that flux will not bypass the extension.

Viewed in cross-section, extension 42 may have a substantially square or rectangular shape. However, additional and/or modified shapes may be employed by those of skill in the art and are within the teachings of the present invention. With further reference to FIG. 3, extension 42 is shown generally having an axial length $AL_6$ and a radial length $L_E$. In an embodiment, assembly 10 may be configured so that the radial length $L_{RF}$ of the fin 26 is greater than the radial length $L_E$ of the extension 42; and/or the axial length $AL_6$ of the fin 26 is less than the radial length $L_{RF}$ of the fin 26. Additionally, embodiments of the assembly 10 may provide for configurations in which the axial length $AL_6$ of the extension is less than the radial length $L_E$ of the extension, and/or the axial length of the fin $AL_3$ is less than the radial length of the fin $L_{RF}$.

In operation of the assembly, a gap is at times provided between the armature 18 and housing 40. In an embodiment, extension 42 is configured to be longer radially and/or axially than the greatest operational gap permitted between fin 26 and the extension 42. As such, the assembly may be configured so that, through the full permitted or operational range of motion of armature 18, the shortest flux path from armature 18 to housing 40 will be through extension 42. With such configurations, the electromagnetic force on fin 26 may by increased when armature 18 is farthest from pole piece 14. Then, as armature 18 moves toward pole piece 14, fin 26 will be in closer communication with extension 42, and an associated flux is permitted to flow in the radial direction—as opposed to creating an axial force. Such configurations can permit the forces associated with pole piece 14 and armature 18 to effectively "balance out," i.e., offset one another, so that the net resulting force is substantially constant. In practice, the extension 42 and fin 26 can be configured so that if a current supplied to the assembly 10 is substantially constant, the associated electromagnetic force will be substantially constant as armature 18 moves relative to pole piece 14. This can be advantageously for a number of applications, including those in which a high force is applied to the full stroke of a proportional solenoid and there is a desire for the associated current to be reliably stable throughout the stroke.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims appended hereto and their equivalents.

What is claimed is:

1. An armature for a solenoid, the armature comprising:

a first portion having a first axial length and a first diameter, the first portion configured for operative connection with a pole piece;

a second portion having a second axial length and a second diameter, the second diameter being larger than the first diameter; and a fin that extends radially from the second portion, the fin having an axial length that is less than an axial length of the second portion and a radial length that is less than a radial length of the second portion, wherein the axial length of the fin is less than the radial length of the fin, and the radial length of the fin is less than the radial length of the first portion.

2. The armature of claim 1, wherein the first portion, second portion, and fin are integrally formed.

3. The armature of claim 1, wherein the armature is comprised of a magnetic material.

4. The armature of claim 3, wherein the magnetic material includes magnetic steel.

5. The armature of claim 1, wherein the first axial length is longer than the second axial length.

6. The armature of claim 5, wherein the first portion include a reduced diameter portion configured to interact with an end of the pole piece.

7. The armature of claim 1, wherein the second diameter is at least twice the first diameter.

8. The armature of claim 1, wherein the axial length of the fin is less than one-half the axial length of the second portion.

9. The armature of claim 1, wherein the fin is axially offset a distance from at least one endpoint of the second portion.

10. The armature of claim 1, wherein, in cross-section, the fin has a substantially rectangular shape.

11. A solenoid assembly, comprising:

a pole piece;

an armature, including a first portion, a second portion, and a fin that extends radially outwardly from the second portion, wherein the fin has a radial length that is less than a radial length of the second portion and an axial length that is less than the radial length of the fin; and a housing that includes an extension for electromagnetic communication with the fin, the extension having an axial length and a radial length, wherein a first gap is provided between the fin and the extension, the radial length of the extension is greater than the first gap, and the axial length of the extension is less than the radial length of the extension.

12. The assembly of claim 11, wherein the radial length of the fin is greater than the radial length of the extension.

13. The assembly of claim 11, wherein, through the full permitted range of motion of the armature, the shortest flux path from the armature to the housing is through the housing extension.

14. The assembly of claim 11, wherein, in cross-section, the extension has a substantially square or rectangular shape.

15. The assembly of claim 11, wherein the electromagnetic force on the fin is increased when the armature is farther from the pole piece.

16. The assembly of claim 11, wherein as the armature moves toward the pole piece, the fin and extension are in closer communication, and an associated flux is permitted to flow in the radial direction.

17. The assembly of claim 11, wherein the assembly is configured so that the forces associated with the pole piece and the armature offset each other so that the net force is substantially constant.

18. The assembly of claim 11, wherein the extension and fin are configured such that if a current supplied to the assembly is substantially constant, the associated electromagnetic force is substantially constant as the armature moves relative to the pole piece.

19. The assembly of claim 11, wherein the assembly includes a magnetic coil.

20. The assembly of claim 11, wherein the axial length of the fin is less than the axial length of the extension.

21. The assembly of claim 11, wherein a second gap is provided between the first portion of the armature and the extension, and wherein the first gap is smaller than the second gap.

22. The assembly of claim 11, wherein the radial length of the extension is greater than the greatest radial gap between the extension and the fin and the greatest axial gap between the extension and the fin.

* * * * *